US008251403B2

(12) United States Patent
Acerboni

(10) Patent No.: US 8,251,403 B2
(45) Date of Patent: Aug. 28, 2012

(54) ALBUM FOR COLLECTING THIN AND FLEXIBLE OBJECTS, IN PARTICULAR PHOTOGRAPHS

(75) Inventor: Mario Acerboni, Brescia (IT)

(73) Assignee: Acerboni Mario, Collebeato (Brescia) (IT)

( * ) Notice: Subject to any disclaimer, the term of this patent is extended or adjusted under 35 U.S.C. 154(b) by 406 days.

(21) Appl. No.: 12/319,993

(22) Filed: Jan. 14, 2009

(65) Prior Publication Data

US 2009/0183404 A1 Jul. 23, 2009

(30) Foreign Application Priority Data

Jan. 17, 2008 (IT) ..... MI20080013 U

(51) Int. Cl.
*B42D 1/08* (2006.01)

(52) U.S. Cl. ..... 281/22; 281/38

(58) Field of Classification Search ..... 281/22, 281/38

See application file for complete search history.

(56) References Cited

U.S. PATENT DOCUMENTS

| | | | | |
|---|---|---|---|---|
| 1,906,311 | A * | 5/1933 | Burgstaller | 281/38 |
| 5,772,349 | A * | 6/1998 | Tubergen | 402/79 |
| 5,941,569 | A * | 8/1999 | Solomons | 281/21.1 |
| 6,447,013 | B1 * | 9/2002 | Francesco | 281/21.1 |

FOREIGN PATENT DOCUMENTS

GB 2260491 A * 4/1993

* cited by examiner

*Primary Examiner* — Gary Hoge

(74) *Attorney, Agent, or Firm* — Hedman & Costigan, P.C.; Kathleen A. Costigan

(57) ABSTRACT

An album (10) is described for collecting thin and flexible objects (22), in particular photos or portraits, comprising a multitude of sheets (12) folded in half along a central folding line (14) and joined together with a binding (16) positioned at such central folding lines (14). Each sheet (12) therefore creates a pair of pages of the album (10). At least part of the sheets (12) is provided, on at least one of the two facing surfaces of each sheet (12), with a frame or perimeter border (18) fastened to the surface of each sheet (12). At least one of the sides of the perimeter frame (18) is not joined to the surface of the sheet (12), so as to be able to be lifted in such a way as to define a passage slit (36) to slide in or take out a photograph (22) or another document of substantially the same size as each sheet (12) between the perimeter frame (18) and the corresponding sheet (12).

5 Claims, 3 Drawing Sheets

ALBUM FOR COLLECTING THIN AND FLEXIBLE OBJECTS, IN PARTICULAR PHOTOGRAPHS

The present invention refers to an album for collecting thin and flexible objects, in particular but not exclusively, photographs or portraits.

Currently, photograph albums are known in which each page is provided, on one or on both opposite faces, with a frame or perimeter border used for storing each single photograph once it has been inserted into the album, allowing it therefore to be seen. It is obvious that, in such a type of album, photographs or other similar objects can be inserted, having maximum dimensions equal to the dimensions of each single page of the album itself. In other words, it is not possible to collect photographs or images in a "panoramic" format, or other documents having a double format, i.e. equal to the size of two pages side by side.

This is why, the so called "photo books" were made, i.e. albums in which the photos, normally taken in a digital format, are printed directly onto the pages of the album itself. It is therefore possible to print photographs with any format, up to a maximum size equal to that of two pages side by side of the photo book.

However, a part from having to be made by specialized laboratories, with a photo book there is no option of being able to take a part or to be put back together for any reason or need, as can be done with a normal photo album.

In other words, the number and the position of the photographs or of the documents contained in a photo book may in no way be changed, for example in order to quickly correct an eventual wrong sequence order.

The purpose of the present invention is therefore to create an album for collecting thin and flexible objects, in particular but not exclusively photographs or portraits, in which it is possible to insert photographs, images and/or other documents having a large format, greater than the sizes of each page of the album itself.

Another purpose of the invention is that of creating an album for collecting photographs in which it is possible to change easily and in any moment the quantity and the arrangement of the photographs or of the other documents contained inside of it.

Yet another purpose of the invention is finally that of creating an album for collecting photographs being able to directly and instantly be used easily by any user, not needing therefore to be prepared beforehand by a specialized laboratory.

These purposes according to the present invention are obtained by creating an album for collecting thin and flexible objects, in particular but not exclusively photographs or portraits, as outlined in claim 1.

Further characteristics of the invention are highlighted in the subsequent claims.

The characteristics and the advantages of an album for collecting thin and flexible objects, in particular but not exclusively photographs or portraits, according to the present invention shall become clearer from the following description, given as an example and not for limiting purposes, referring to the attached schematic drawings in which.

Figure 1:
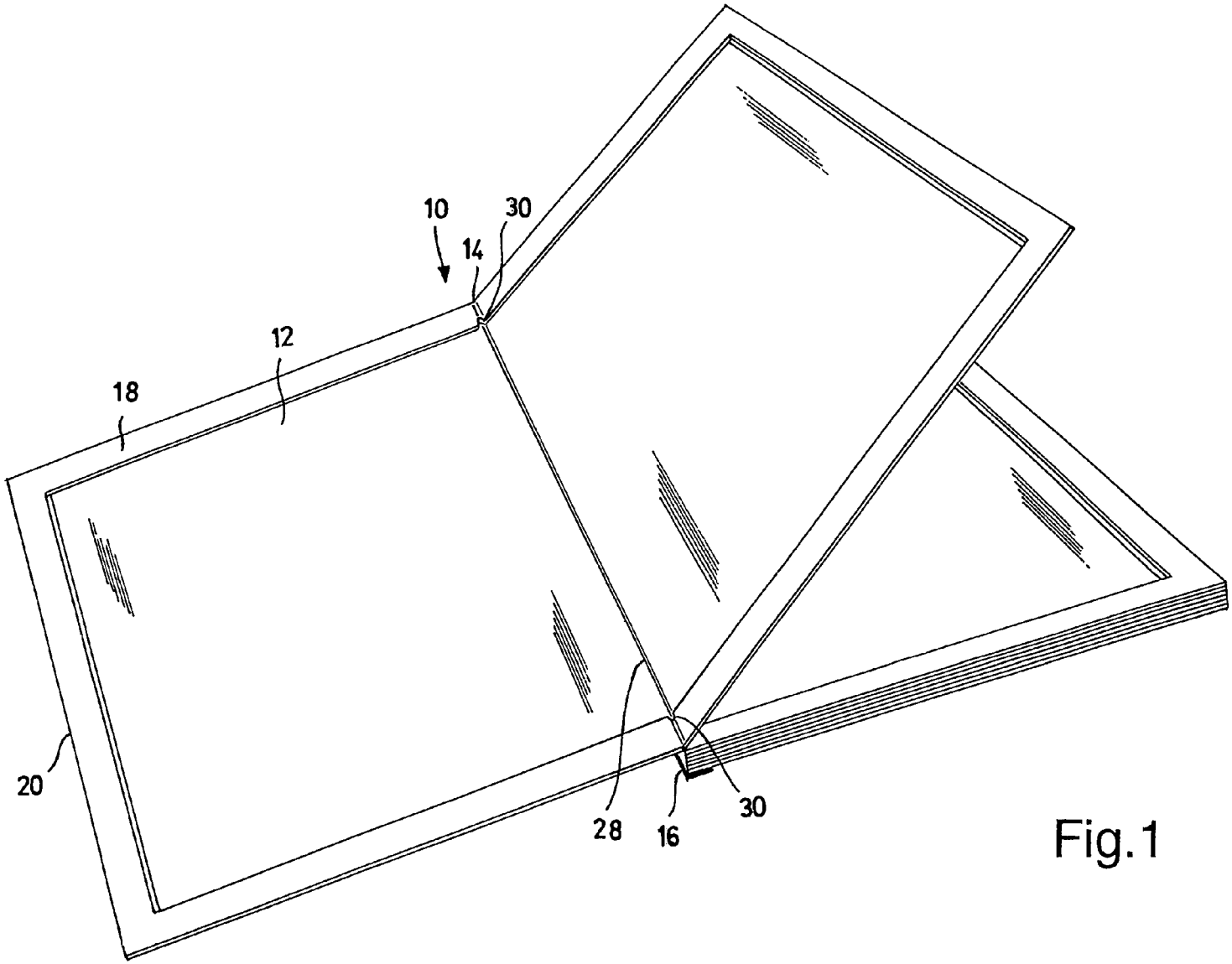
FIG. 1 is a perspective view that shows an album created according to the invention.

With reference to the figures, an album for collecting thin and flexible objects, in particular but not exclusively photographs or portraits, is shown, created according to the present invention and indicated as a whole with reference numeral 10.

The album 10 comprises a plurality of sheets 12 folded centrally in half along a central folding line 14 and joined together by a binding 16 positioned at such central folding lines 14 of the various sheets 12. Each sheet 12 therefore forms a pair pages of the album 10 and is provided, on at least one of its two opposite surfaces, preferably the inner surface folded upon itself, with a frame or perimeter border 18 made from cardboard, fixed to the surface of the sheet 12 for example with glue.

Figure 2:
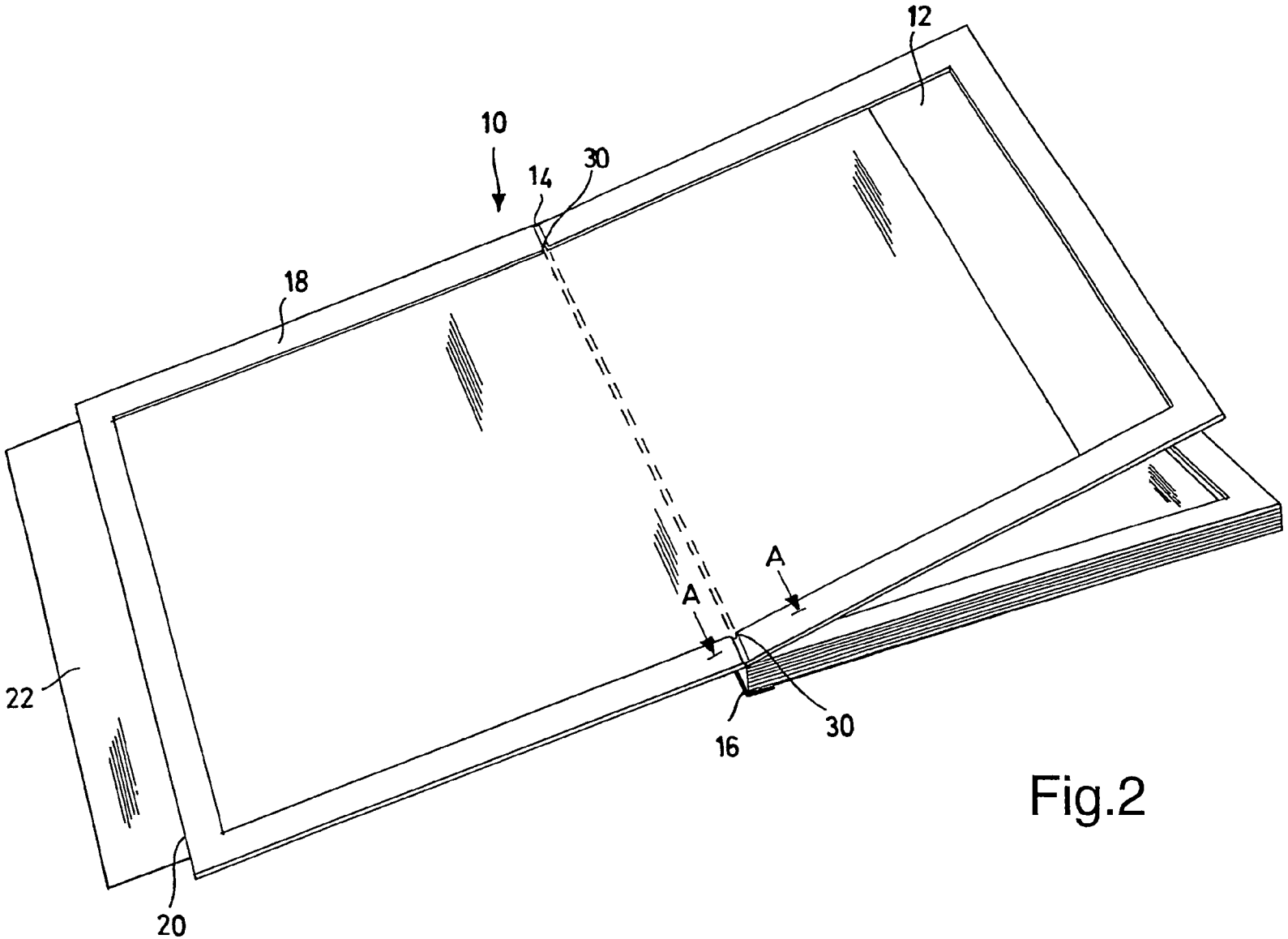
FIG. 2 is a perspective view that shows the album of FIG. 1 inside of which a generic thin and flexible object, such as for example a photograph, is being inserted.

At least one of the sides of the perimeter frame 18, preferably a side 20 parallel and opposite to the central folding line 14, is not glued to the surface of the sheet 12, so as to be able to be lifted in such a way as to define a passage slit 36 (FIG. 4) for sliding in or taking out a photograph 22 (shown in FIG. 2) or any other thin and flexible object, for example a portrait, a document and so on, between the perimeter frame 18 and the underlying relative sheet 12.

Figure 3:
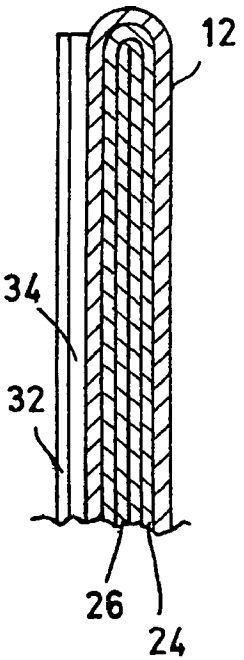
FIG. 3 shows an enlargement of a section view, obtained along the line A-A of FIG. 2, of a portion of the album of FIG. 1.

Preferably, as shown in the section view of FIG. 3, the perimeter frame 18 comprises a first inner layer 24, at least partially glued to the surface of the sheet 12 in the aforementioned way, and a second surface layer 26, overlapping and integrally glued on to such first inner layer 24. The second surface layer 26 of the perimeter frame 18 is therefore configured so as to define a smaller window compared to that created by the first inner layer 24, so as to define a step (not shown) between the two layers 24 and 26 which works both as a guide to slide in and take out the photograph 22, as well as a centring and stopping border for the photograph 22 itself once inserted into the album 10.

In such a way, since the perimeter frame 18 applied on each sheet 12 surrounds a pair of adjacent pages of the album 10, it is possible to insert inside the album 10 itself, large photographs 22 or other documents having sizes substantially equal to those of each sheet 12, i.e. equal to two whole pages of the album 10.

The central fold of each photograph 22 inserted inside the album 10 can automatically be created in the act of closing the album 10 itself, or it can be helped thanks to the presence of a predetermined string 28 created on each sheet 12 at its central folding line 14. On the perimeter frame 18, at the central folding line 14 and therefore at the string 28, one or more weakening slits 30 can be created in order to further facilitate the folding of each sheet 12 and, consequently, of the photograph 22 inserted inside of it.

Figure 4:
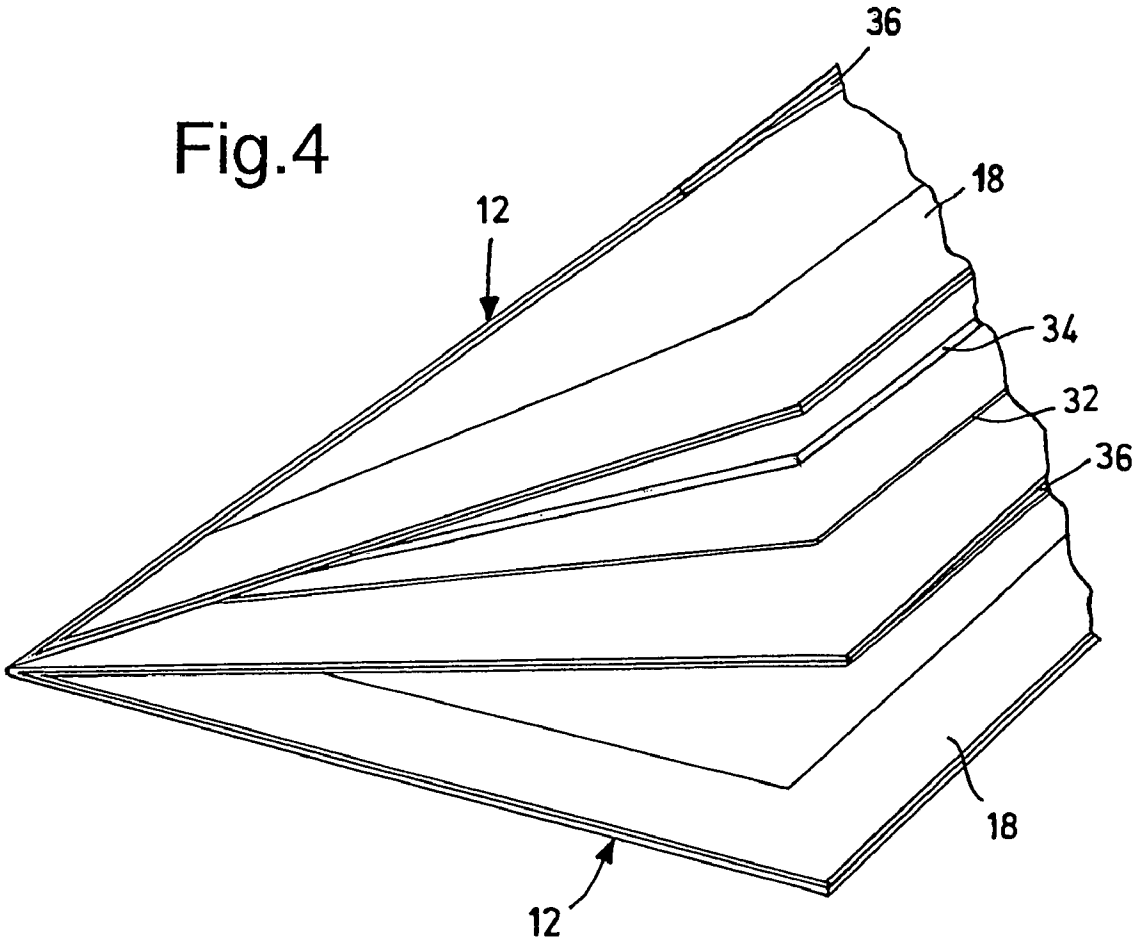
FIG. 4 is an enlarged perspective view that shows a detail of some pages of the album of FIG. 1.

As shown in FIGS. 3 and 4, on the external surface of each sheet 12, i.e. on the surface opposite that holding the photograph 22, it is possible to fixedly attach, for example by gluing, one or more layers of cardboard 32 and 34 of variable thickness, functioning both as a separator of pairs of contiguous and folded sheets 12, as well as a stiffening element of the album 10. Alternatively, if both the surfaces of each sheet 12 are to be used for containing photographs 22 or other documents, the layers of cardboard 32 and 34 can also not be present.

The sheets 12 of the album 10 can be made in the vertical format, shown in the figures, in the horizontal format, or in any other format and with sizes according to the requirements of the user. Also the central string 28, when present, can be of any shape and size, compatible with the size of the sheet 12 on which it is formed. Furthermore, the passage slit 36 for sliding in or taking out the photographs 22 can be obtained, according to need, either on any single side of each sheet 12, or possibly on more than a single side.

It has now been shown that the album for collecting thin and flexible objects, in particular but not exclusively for photographs or portraits, according to the present invention obtains the aforementioned purposes.

The album according to the invention thus conceived can undergo numerous modifications and variants, all of which are covered by the inventive concept; moreover, all the details can be replaced by technically equivalent elements, whereas the shapes and sizes, can be whatever according to the technical requirements.

The scope of protection of the invention is therefore defined by the attached claims.

The invention claimed is:

1. Album (10) for collecting thin and flexible objects (22), in particular photographs or portraits, comprising a plurality of sheets (12) folded centrally on themselves along a central folding line (14) and joined together by a binding (16) positioned at said central folding lines (14), each of said sheets (12) forming a pair of pages of the album (10), characterized in that at least part of said sheets (12) is provided, on at least one of the two opposite surfaces of each sheet (12), with a frame or perimeter border (18) connected to the surface of each sheet (12), at least one of the sides of said perimeter frame (18) not being fixed to the surface of the sheet (12) so as to be able to be lifted in such a way as to define a passage slit (36) for sliding in and taking out an object (22), of substantially the same size of each sheet (12), between said perimeter frame (18) and the relative sheet (12) wherein each sheet (12) is provided with a predetermined string (28) made at the central folding line (14), and wherein on said perimeter frame (18), at said string (28), one or more weakening slits (30) are formed to facilitate the folding of each sheet (12) and, consequent simultaneous folding of the flexible object (22) of substantially the same size of each sheet (12), where the flexible object (22) is capable of sliding between said perimeter frame (18) and the sheet (12) on a surface of said sheet (12) that forms a pair of pages of said album (10).

2. Album (10) according to claim 1, characterized in that said perimeter frame (18) comprises a first inner layer (24), at least partially glued to the surface of the sheet (12), and a second surface layer (26), overlapping and integrally glued onto said first inner layer (24).

3. Album (10) according to claim 2, characterized in that said second surface layer (26) of said perimeter frame (18) is configured to define a smaller window compared to that created by said first inner layer (24), so as to define a step between the two layers (24, 26) that functions both as a guide to slide in and take out said object (22), as well as a border for centring and stopping said object (22) once inserted inside the album (10).

4. Album (10) according to claim 1, characterized in that on the surface of each sheet (12) opposite the one that holds said object (22) one or more layers of cardboard (32, 34) with variable thickness are fixed, having the function of separating pairs of folded and contiguous sheets (12) and of stiffening the album (10).

5. Album (10) according to claim 1, characterized in that the side of said perimeter frame (18) provided with said passage slit (36) is a side (20) parallel and opposite to said central folding line (14).

* * * * *